US005909089A

United States Patent [19]

Deurloo et al.

[11] Patent Number: 5,909,089

[45] Date of Patent: Jun. 1, 1999

[54] DISCHARGE LAMP IGNITING AND OPERATING CIRCUIT WITH A TIMER CONTROLLED OUTPUT VOLTAGE LIMIT

[75] Inventors: Oscar J. Deurloo, Eindhoven; Franciscus H. T. Lammers, Oss, both of Netherlands

[73] Assignee: U.S. Philips Corporation, New York, N.Y.

[21] Appl. No.: 08/834,411

[22] Filed: Apr. 16, 1997

[30] Foreign Application Priority Data

Apr. 18, 1996 [EP] European Pat. Off. ..... 96201035

[51] Int. Cl.[6] ..... H05B 37/02

[52] U.S. Cl. ..... 315/307; 315/224; 315/DIG. 2

[58] Field of Search ..... 315/224, 209 R, 315/307, 219, 226, DIG. 5, DIG. 7, DIG. 2, 289, 290, 291

[56] References Cited

U.S. PATENT DOCUMENTS 4,962,336 10/1990 Dodd et al. ..... 315/290

5,317,237 5/1994 Allison et al. ..... 315/307

FOREIGN PATENT DOCUMENTS 0401931 12/1990 European Pat. Off. .

*Primary Examiner*—Don Wong
*Assistant Examiner*—David H. Vu
*Attorney, Agent, or Firm*—Bernard Franzblau

[57] ABSTRACT

The invention relates to a circuit arrangement for igniting and operating a high-pressure discharge lamp provided with a control circuit which limits the voltage to a value Vb across the output terminals of the circuit arrangement such that:

$$Vla<Vb<Vi.$$

wherein Vla is the nominal lamp voltage and Vi is the threshold voltage across the output terminals at which the ignitor starts.

8 Claims, 2 Drawing Sheets

DISCHARGE LAMP IGNITING AND OPERATING CIRCUIT WITH A TIMER CONTROLLED OUTPUT VOLTAGE LIMIT

BACKGROUND OF THE INVENTION

The invention relates to a circuit arrangement for igniting and operating a high-pressure discharge lamp, provided with input terminals for connection to a supply source, output terminals for connection to the lamp a switching device for operating the lamp at a nominal lamp voltage Vla during stable lamp operation and for generating an open voltage Vo at the output terminals before the lamp has ignited, an ignitor for generating an ignition voltage pulse when the voltage at the output terminals reaches a threshold value Vi, and a control circuit for controlling the switching device.

A conventional circuit arrangement, such as disclosed in European Patent No. 0401931 (corresponding to U.S. Pat. No. 5,068,572) is suitable for igniting and operating, inter alia, high-pressure sodium lamps and metal halide lamps. These lamps typically have a discharge vessel in which an electric discharge is maintained during operation and which is enclosed with intervening space by an outer bulb. An ignitor produces a high ignition voltage pulse (a few kV and more). The ignitor becomes operative through the choice of an open circuit voltage Vo across the output of a commutator being greater than the voltage threshold Vi for triggering ignition of the lamp, that is, Vo>Vi. Once the ignitor becomes operative, an ignition voltage pulse is generated. The lamp will ignite and the voltage across the lamp will drop abruptly to around ten volts. As soon as a stable discharge is established in the lamp, the voltage across the lamp gradually rises to the lamp voltage Vla. The circuit arrangement is so designed that the lamp voltage Vla is lower than the voltage Vi, which in its turn is lower than the open voltage Vo.

A control circuit ensures that switching device of the circuit arrangement acts as a controlled current generator when in the stable operational state of the lamp. No more ignition voltage pulses are generated by the ignitor as soon as the voltage at the circuit arrangement connection terminals to the lamp drops to the lamp voltage Vla or lower. The generation of ignition voltage pulses after the lamp ignites is undesirable because this forms a load on the circuit arrangement. It is often suggested in the literature, therefore, to limit the operation of the ignitor by switching it off after a certain period of time has elapsed.

Conventional ignitors which are turned off after a prefixed period has elapsed have a number of disadvantages. These disadvantages include a comparatively high open voltage Vo remaining at the output terminals if the lamp has not yet ignited. The ignitor will also generate ignition voltage pulses after the lamp is extinguished, for example upon reaching the end of its operational life. High-pressure sodium lamps and metal halide lamps can ignite upon the application of ignition voltage pulses at the end of life after extinguishing and cooling-down. This gives rise to the characteristic flickering behavior of the lamp. Flickering is unpleasant to observe, but more importantly, is detrimental to the circuit arrangement and typically leads a considerable amount of interference radiation (radio interference, etc.).

SUMMARY OF THE INVENTION

It is an object of the invention to overcome the above disadvantages. According to the invention, a circuit arrangement of the kind mentioned in the opening paragraph is characterized by the control circuit comprising means for limiting the voltage at the output terminals to a value Vb such that $$Vla<Vb<Vi.$$

The control circuit by limiting the voltage across the output terminals to a voltage Vb which is just above the nominal lamp voltage Vla but below the ignition threshold Vi, as measured across the output terminals of the circuit arrangement, advantageously suppresses the generation of ignition voltage pulses applied to a lamp which has difficulty starting or which is at its end of life. A further advantage is that a discharge in the outer bulb of the lamp, either in the form of a glow discharge or in the form of an arc discharge, cannot be maintained when the discharge vessel of the lamp becomes leaky. Hazardous situations are thereby prevented. A particularly suitable embodiment of the means for limiting the voltage at the output terminals comprises a timer which after a preset time interval brings the control circuit into a state such that the voltage occurring at the output terminals is limited to the value Vb. Preferably, the timer is so connected that it is reset upon application of a supply source thereto. A voltage buffer network can be coupled to the timer in order to prevent (shield) the timer from being reset when a short dip (i.e. transient condition) occurs in the supply voltage delivered by the supply source. The network can include, for example, an RC network. A down converter or Buck converter can serve as the controlled current generator.

BRIEF DESCRIPTION OF THE DRAWINGS

The above and further aspects of the invention will be explained in more detail below with reference to a drawing of an embodiment of a circuit according to the invention, in which.

DETAILED DESCRIPTION OF THE PREFERRED EMBODIMENT

Figure 1:
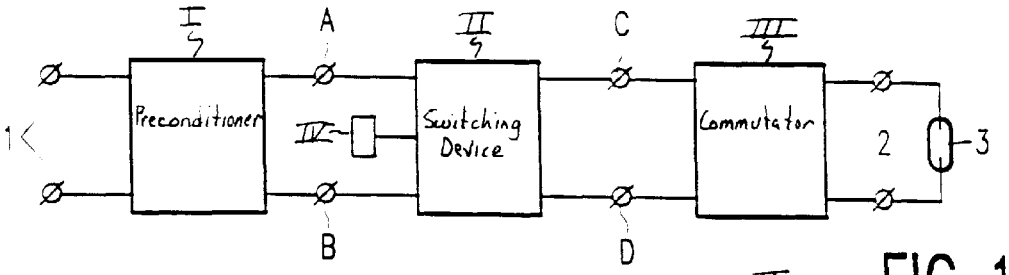
FIG. 1 shows a circuit arrangement for igniting and operating a high-pressure discharge lamp.

FIG. 1 shows a circuit arrangement for igniting and operating a high-pressure discharge lamp provided with a pair of input terminals 1 for connecting a supply source, output terminals 2 for connecting the lamp 3, a switching device (constant current generator) II for operating the lamp at a nominal lamp voltage Vla during stable lamp operation and for generating an open voltage Vo at the output terminals before the lamp has ignited. The circuit arrangement is also provided with commutator means III for periodically changing the polarity of the current through the lamp, and with a preconditioner I for generating a DC voltage for supplying the switching device II. Preconditioner I can be a boost/up converter. Commutator III, which includes an ignitor VI for generating an ignition voltage pulse when the voltage at the output terminals reaches a threshold value Vi, is formed as a full bridge (can also be a half bridge) operating at a fixed frequency. Stabilization is performed by switching device II. The circuit arrangement is further provided with a control circuit IV for controlling switching device II and with a reference generator V for limiting the voltage at the output terminals to a value Vb such that $$Vla<Vb<Vi.$$

Figure 2:
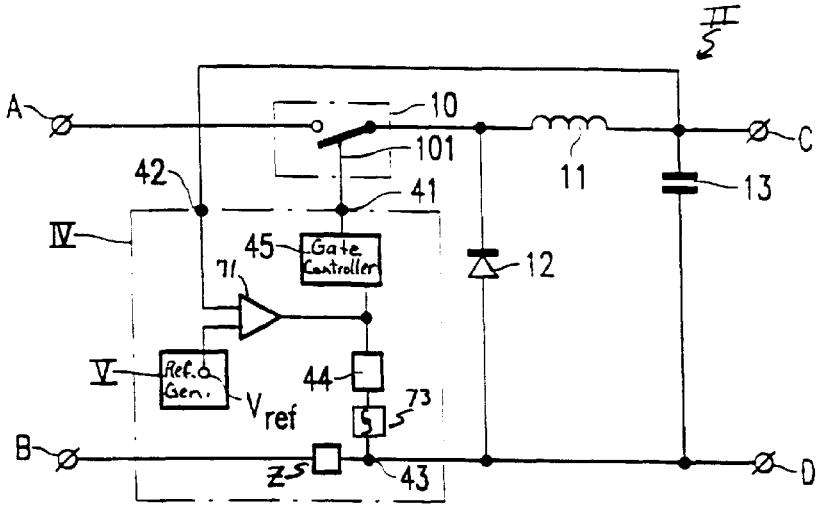
FIG. 2 shows a switching device of FIG. 1 in detail.

Switching device II can include a down converter or Buck converter as shown in FIG. 2. A and B are connection points between switching device II and the preconditioner I and C and D are connection points between switching device II and commutator III. Switching device II comprises a controlled semiconductor switch 10, a self-inductance 11 and a free-wheel diode 12. The converter is further provided with a capacitor 13 for reducing ripple of the voltage across the connection points C, D. A control electrode 101 of switch 10 is connected to an output 41 of the control circuit IV. The control circuit has an input 42 for detecting a signal Sv which is proportional to the voltage at output terminals 2 and an input 43 for detecting a signal Si which is proportional to the lamp current and formed over a small preferably ohmic impedance z. The signal Sv is compared with a reference voltage Vref by a comparator 71. The result of this comparison is supplied to a gate controller 45. The signal Si is supplied through an integrator 73 to a Pulse Width Modulator (PWM) 44, which in its turn sends a switching signal to the gate controller 45. The control signal generated in the gate controller 45 is supplied to the control electrode 101 through output 41.

The reference voltage Vref forms part of the reference generator V for limiting the voltage at the output terminals to a value Vb such that $$Vla<Vb<Vi.$$

Figure 3:
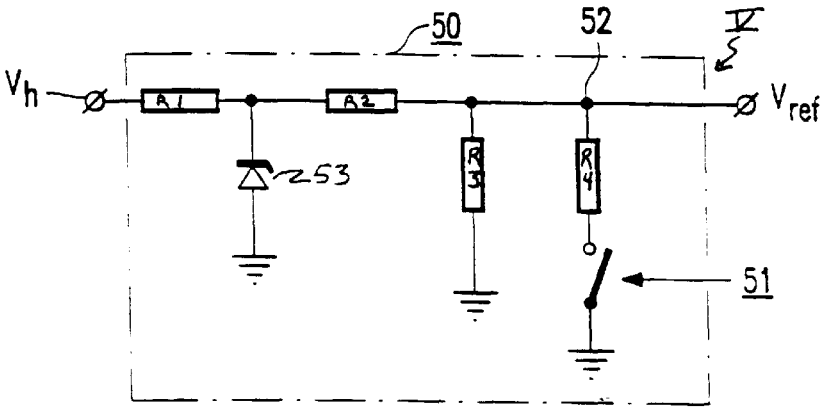
FIG. 3 shows circuitry for limiting the voltage at the output terminals of the circuit arrangement.

The reference generator V is shown in more detail in FIG. 3. The reference voltage Vref is provided at connection point 52 from an auxiliary voltage Vh based on a voltage divider network 50. Voltage divider network 50 includes a plurality of resistors R1, R2, R3 and R4, a zener diode 53 and a switch 51. Resistors R1 and R2 are serially connected between the terminals which are at an auxiliary voltage Vh and at a reference voltage Vref. Zener diode 53 is connected between the junction joining resistors R1 and R2 together and ground. Resistor R3 is connected between the reference voltage Vref terminal and ground. Resistor R4 and switch 51 are serially connected between connection point 52 (i.e. the reference voltage Vref terminal) and ground. Auxiliary voltage Vh is typically 15 volts derived from a 220 volt, 50 Hz supply. Switch 51 shunts a portion of the voltage divider network impedance. When switch 51 is closed, the voltage at connection point 52 drops as compared to when switch 51 is opened. When switch 51 is placed between the auxiliary voltage Vh terminal and connection point 52, a reduction in the voltage at connection point 52 will take place when switch 51 is opened. A low voltage at connection point 52 results in a low value for the reference voltage Vref. Gate controller 45 in response to the reference voltage Vref being at a low level opens semiconductor switch 10 such that the voltage at output terminals 2 is limited to a comparatively low value.

Figure 5:
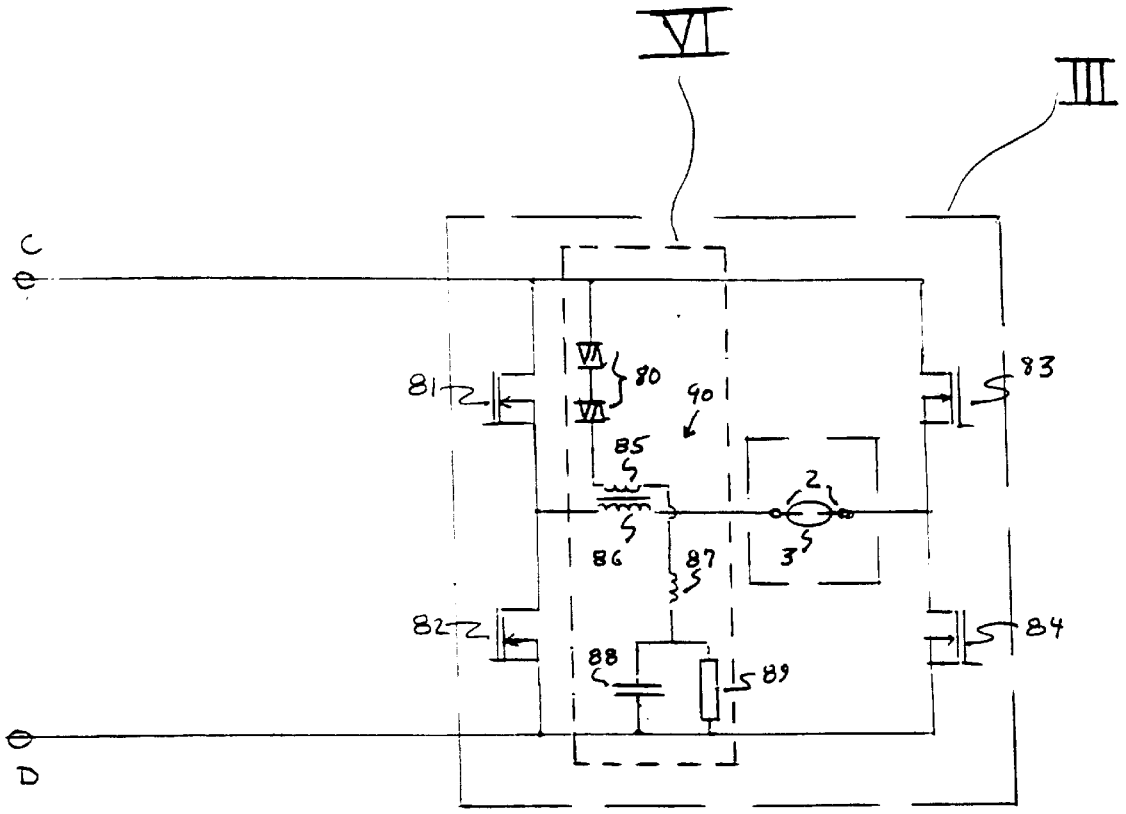
FIG. 5 shows the inverter and ignitor of FIG. 1.

As shown in FIG. 5, commutator m is of the full bridge type having four MOSFET transistors 81, 82, 83 and 84. A pair of voltage breakdown elements 80 are serially connected between connection point C and one end of a primary coil 85 of an ignition transformer 90. The other end of primary coil 85 is connected to a current limiting coil 87 which limits the current flowing through voltage breakdown elements 80. The parallel combination of a capacitor 88 and a resistor 89 are connected between current limiting coil 87 and connection point D. Transistors 81 and 82 are serially connected between connection points C and D. Similarly, transistors 83 and 84 are serially connected between connection points C and D. A secondary coil winding 86 of ignition transformer 90 and output terminals 2 are serially connected between the junction joining transistors 81 and 82 together and the junction joining transistors 83 and 84 together.

Each of the voltage breakdown elements 80 can be a SIDAC having a breakdown voltage of 120 volts such as a Motorola part no. MKP1V120. Primary coil winding 85 can have four windings and secondary coil winding 86 can have seventy six windings. Current limiting coil 87 can have a value of 82 $\mu$H such as a Toko part no. 8RHT. Capacitor 88 can have a value of 68 nF and resistor 89 can have a value of 33K ohms.

As soon as the voltage across output terminals 2 reaches a voltage at which elements 80 breakdown, a voltage pulse is applied across primary coil winding 85. The voltage pulse is stepped up by a secondary coil winding into an ignition pulse which is applied across output terminals 2. Capacitor 88 now charges. The increasing voltage of capacitor 88 will cause elements 80 to switch to their nonconductive states. Resistor 89 provides a discharge path for capacitor 88. The voltage across output terminals 2 will begin to rise again until reaching a voltage at which elements 80 breakdown again. The generation of an ignition pulse is repeated until the voltage across output terminals 2 stays below the voltage required to breakdown elements 80.

Figure 4:
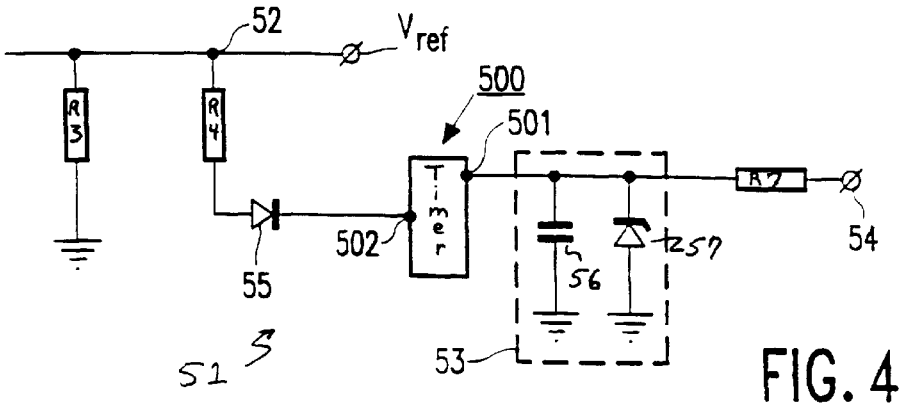
FIG. 4 shows the switch of FIG. 3.

Referring now to FIG. 4, switch 51 includes the serial combination of a diode 55, a timer 500, a voltage buffer network 53, a resistor R7 and a connection point 54 for connecting a supply voltage for supplying timer 500. Voltage buffer network 53 includes a capacitor 56 and a zener diode 57 connected in parallel between input terminal 501 and ground. Switch 51 operates as follows. The moment a supply voltage is connected to connection point 54, a voltage will be applied to input terminal 501 of timer 500, whereby the timer is reset. A high logic level is produced at an output terminal 502 of timer 500 which corresponds to a comparatively high voltage at connection point 52. After a period of time, set by timer 500, has elapsed, timer 500 switches over and the voltage at output terminal 502 becomes low so that the voltage at connection point 52 also becomes low.

In a practical realization of a circuit arrangement according to the embodiment described, the circuit arrangement is suitable for igniting and operating a metal halide lamp, for example of the CDM 35W type, made by Philips Electronics, N.V., Eindhoven, The Netherlands, with a power rating of 39 W. The lamp has a rated lamp voltage Vla of 90 V. When the supply source, for example a voltage source of 220 V, 50 Hz, is connected to the circuit arrangement, preconditioner I supplies a DC voltage of 400 V to the switching device II. The open circuit voltage at output terminals 2 is between 310 and 380 V when the lamp has not ignited. The threshold value Vi of the voltage at the output terminals at which ignitor VI starts generating ignition pulses is 240 V.

Timer 500 can be an HEF 4541 integrated circuit made by Philips Electronics, N.V. Eindhoven, The Netherlands. Capacitor 56 of the voltage buffer network can be a 100 nF capacitor. Zener diode 57 can have a zener voltage of 15 V. The rectified supply source voltage of 220 V serves as the supply voltage for timer 500. To limit the current, resistor R7 having a resistance of 300 kΩ is connected between connection point 54 and voltage buffer network 53. Diode 55 is of the BAV 103 type, made by Philips Electronics N.V., Eindhoven, The Netherlands. The value of Vref is 3.3 V when timer 500 is reset. When timer 500 switches over after at most 20 min, Vref drops to 1.5 V, which results in a limitation of the voltage at the output terminals to a value Vb of at most 200 V. It is clear that the condition $$Vla<Vb<Vi$$

is thus complied with.

Timer 500 is so set that it switches over after a minimum of about 10 min and a maximum of about 20 min. This time is preferably chosen to provide the possibility of hot re-ignition of the lamp. Controlled semiconductor switch 10 of switching device II is formed by a MOSFET, type STP4NA60FI, made by SGS-Thomson. The gate controller is an integrated circuit, type IR2117, made by International Rectifier. The PWM 44 is an integrated circuit, type L6560A, made by SGS-Thomson.

It will thus be seen that the objects set forth above and those made apparent from the preceding description are efficiently attained and, since certain changes can be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

We claim:

1. A circuit arrangement for igniting and operating a high-pressure discharge lamp, comprising:

input terminals for connection to a supply source, output terminals for connection to the lamp, switching means for operating the lamp at a nominal lamp voltage Vla during stable lamp operation and for generating an open voltage Vo at the output terminals before the lamp has ignited, ignition means responsive to the voltage at the output terminals for generating an ignition voltage pulse when the voltage at the output terminals reaches a threshold value Vi, and a control circuit for controlling the switching means, characterized in that the control circuit includes means for limiting the voltage at the output terminals to a level Vb such that $$Vla<Vb<Vi.$$

2. The circuit arrangement of claim 1, wherein the control circuit includes a timer for establishing a prefixed period of time after which the voltage at the output terminals is at the level $V_b$.

3. The circuit arrangement of claim 2, wherein the control circuit further includes a voltage buffer network coupled to the timer to shield the timer from transient conditions occurring in the supply source.

4. The circuit arrangement of claim 3, wherein the control circuit is responsive to the voltage across the output terminals and current flowing through the lamp.

5. The circuit arrangement of claim 4, wherein the prefixed period of time is set to provide hot reignition of the lamp.

6. The circuit arrangement of claim 1, wherein the control circuit is responsive to the voltage across the output terminals and current flowing through the lamp.

7. The circuit arrangement of claim 2, wherein the prefixed period of time is set to provide hot reignition of the lamp.

8. The circuit arrangement of claim 2, wherein the timer includes a reset which is enabled upon application of a supply voltage thereto.

* * * * *